US007298387B2

(12) United States Patent
Busch et al.

(10) Patent No.: US 7,298,387 B2
(45) Date of Patent: Nov. 20, 2007

(54) THERMAL RESPONSE CORRECTION SYSTEM

(75) Inventors: Brian D. Busch, Sudbury, MA (US); Suhail S. Saquib, Shrewsbury, MA (US); William T. Vetterling, Lexington, MA (US)

(73) Assignee: Polaroid Corporation, Waltham, MA (US)

( * ) Notice: Subject to any disclaimer, the term of this patent is extended or adjusted under 35 U.S.C. 154(b) by 165 days.

(21) Appl. No.: 10/910,880

(22) Filed: Aug. 4, 2004

(65) Prior Publication Data

US 2005/0007438 A1 Jan. 13, 2005

Related U.S. Application Data

(63) Continuation-in-part of application No. 10/831,925, filed on Apr. 26, 2004, and a continuation-in-part of application No. 09/934,703, filed on Aug. 22, 2001, now Pat. No. 6,819,347.

(51) Int. Cl.
*B41J 2/00* (2006.01)

(52) U.S. Cl. ..... 347/194

(58) Field of Classification Search ..... 347/194, 347/195, 196, 189; 400/120.08
See application file for complete search history.

(56) References Cited

U.S. PATENT DOCUMENTS

| | | | | |
|---|---|---|---|---|
| 4,070,587 | A | 1/1978 | Hanakata | 307/141 |
| 4,284,876 | A | 8/1981 | Ishibashi et al. | 219/216 |
| 4,309,712 | A | 1/1982 | Iwakura | 346/76 |
| 4,347,518 | A | 8/1982 | Williams et al. | 346/1.1 |
| 4,364,063 | A | 12/1982 | Anno | 346/76 |
| 4,391,535 | A | 7/1983 | Palmer | 400/120 |
| 4,415,908 | A | 11/1983 | Sugiura | 346/76 |
| 4,443,121 | A | 4/1984 | Arai | 400/120 |
| 4,464,669 | A | 8/1984 | Sekiya et al. | 346/76 |
| 4,514,738 | A | 4/1985 | Nagato et al. | 346/76 |
| 4,524,368 | A | 6/1985 | Inui et al. | 346/76 |
| 4,563,691 | A | 1/1986 | Noguchi et al. | 346/76 |
| 4,607,262 | A | 8/1986 | Moriguchi et al. | 346/76 |
| 4,688,051 | A | 8/1987 | Kawakami et al. | 346/76 |
| 5,006,866 | A | 4/1991 | Someya | 346/76 |
| 5,066,961 | A | 11/1991 | Yamashita | 346/76 |
| 5,086,306 | A | 2/1992 | Sasaki | 346/76 |
| 5,115,252 | A | 5/1992 | Sasaki | 346/76 |
| 5,132,703 | A | 7/1992 | Nakayama | 346/76 |

(Continued)

FOREIGN PATENT DOCUMENTS

| | | |
|---|---|---|
| EP | 0 110 675 A2 | 6/1984 |

(Continued)

*Primary Examiner*—K. Feggins

(57) ABSTRACT

Techniques are disclosed for performing thermal history control in a thermal printer in which a single thermal print head prints sequentially on multiple color-forming layers in a single pass. Each pixel-printing interval may be divided into subintervals, which may be of unequal duration. Each sub-interval may be used to print a different color. The manner in which the input energy to be provided to each print head element is selected may be varied for each of the subintervals. For example, although a single thermal model may be used to predict the temperature of the print head elements in each of the subintervals, different parameters may be used in the different subintervals. Similarly, different energy computation functions may be used to compute the energy to be provided to the print head in each of the subintervals based on the predicted print head temperature.

28 Claims, 8 Drawing Sheets

U.S. PATENT DOCUMENTS

| | | | | |
|---|---|---|---|---|
| 5,132,709 | A | 7/1992 | West | 346/76 |
| 5,162,813 | A | 11/1992 | Kuroiwa et al. | 346/1.1 |
| 5,184,150 | A | 2/1993 | Sugimoto | 346/76 |
| 5,248,995 | A | 9/1993 | Izumi | 346/76 |
| 5,268,706 | A | 12/1993 | Sakamoto | 346/76 |
| 5,422,662 | A | 6/1995 | Fukushima | 342/211 |
| 5,539,443 | A | 7/1996 | Mushika et al. | 347/194 |
| 5,576,745 | A | 11/1996 | Matsubara | 347/14 |
| 5,623,297 | A | 4/1997 | Austin et al. | 347/194 |
| 5,625,399 | A | 4/1997 | Wiklof et al. | 347/195 |
| 5,642,148 | A | 6/1997 | Fukushima | 347/211 |
| 5,644,351 | A | 7/1997 | Matsumoto et al. | 347/194 |
| 5,646,672 | A | 7/1997 | Fukushima | 347/211 |
| 5,706,044 | A | 1/1998 | Fukushima | 347/211 |
| 5,719,615 | A | 2/1998 | Hashiguchi et al. | 347/195 |
| 5,800,075 | A | 9/1998 | Katsuma et al. | 400/120 |
| 5,808,653 | A | 9/1998 | Matsumoto et al. | 347/194 |
| 5,841,461 | A | 11/1998 | Katsuma | 347/195 |
| 5,889,546 | A | 3/1999 | Fukuoka | 347/188 |
| 5,999,204 | A | 12/1999 | Kojima | 347/194 |
| 6,186,683 | B1 | 2/2001 | Shibuki | 400/120.8 |
| 6,537,410 | B2 | 3/2003 | Arnost et al. | 156/235 |
| 2003/0043251 | A1 | 3/2003 | Saquib et al. | 347/194 |
| 2003/0125206 | A1 | 7/2003 | Bhatt et al. | 503/201 |

FOREIGN PATENT DOCUMENTS

| | | |
|---|---|---|
| EP | 0 790 131 A1 | 8/1997 |
| JP | 58-164368 | 9/1983 |
| JP | 59-127781 | 7/1984 |
| JP | 02-248264 | 10/1990 |
| JP | 02-289364 | 11/1990 |
| JP | 3-024972 | 2/1991 |
| JP | 03-024972 | 2/1991 |
| JP | H03-24972 | 2/1991 |

THERMAL RESPONSE CORRECTION SYSTEM

CROSS REFERENCE TO RELATED APPLICATIONS

This application is a continuation-in-part of U.S. patent application Ser. No. 10/831,925, filed on Apr. 26, 2004, entitled "Thermal Response Correction System," which is a continuation-in-part of U.S. patent application Ser. No. 09/934,703, filed on Aug. 22, 2001, entitled "Thermal Response Correction System," now U.S. Pat. No. 6,819,347 B2 which are both hereby incorporated by reference.

This application is related to a copending and commonly owned U.S. patent application Ser. No. 10/151,432, filed on May 20, 2002, entitled "Thermal Imaging System,", now U.S. Pat. No. 6,801,233 B2 which is hereby incorporated by reference.

BACKGROUND

1. Field of the Invention

The present invention relates to thermal printing and, more particularly, to techniques for improving thermal printer output by compensating for the effects of thermal history on thermal print heads.

2. Related Art

Thermal printers typically contain a linear array of heating elements (also referred to herein as "print head elements") that print on an output medium by, for example, transferring pigment or dye from a donor sheet to the output medium or by activating a color-forming chemistry in the output medium. The output medium is typically a porous receiver receptive to the transferred pigment, or a paper coated with the color-forming chemistry. Each of the print head elements, when activated, forms color on the medium passing underneath the print head element, creating a spot having a particular density. Regions with larger or denser spots are perceived as darker than regions with smaller or less dense spots. Digital images are rendered as two-dimensional arrays of very small and closely-spaced spots.

A thermal print head element is activated by providing it with energy. Providing energy to the print head element increases the temperature of the print head element, causing either the transfer of pigment to the output medium or the formation of color in the receiver. The density of the output produced by the print head element in this manner is a function of the amount of energy provided to the print head element. The amount of energy provided to the print head element may be varied by, for example, varying the amount of power to the print head element within a particular time interval or by providing power to the print head element for a longer time interval.

In conventional thermal printers, the time during which a digital image is printed is divided into fixed time intervals referred to herein as "print head cycles." Typically, a single row of pixels (or portions thereof) in the digital image is printed during a single print head cycle. Each print head element is typically responsible for printing pixels (or subpixels) in a particular column of the digital image. During each print head cycle, an amount of energy is delivered to each print head element that is calculated to raise the temperature of the print head element to a level that will cause the print head element to produce output having the desired density. Varying amounts of energy may be provided to different print head elements based on the varying desired densities to be produced by the print head elements.

One problem with conventional thermal printers results from the fact that their print head elements retain heat after the conclusion of each print head cycle. This retention of heat can be problematic because, in some thermal printers, the amount of energy that is delivered to a particular print head element during a particular print head cycle is typically calculated based on an assumption that the print head element's temperature at the beginning of the print head cycle is a known fixed temperature. Since, in reality, the temperature of the print head element at the beginning of a print head cycle depends on (among other things) the amount of energy delivered to the print head element during previous print head cycles, the actual temperature achieved by the print head element during a print head cycle may differ from the desired temperature, thereby resulting in a higher or lower output density than is desired. Further complications are similarly caused by the fact that the current temperature of a particular print head element is influenced not only by its own previous temperatures—referred to herein as its "thermal history"—but by the ambient (room) temperature and the thermal histories of other print head elements in the print head.

As may be inferred from the discussion above, in some conventional thermal printers, the average temperature of each particular thermal print head element tends to gradually rise during the printing of a digital image due to retention of heat by the print head element and the over-provision of energy to the print head element in light of such heat retention. This gradual temperature increase results in a corresponding gradual increase in density of the output produced by the print head element, which is perceived as increased darkness in the printed image. This phenomenon is referred to herein as "density drift."

Furthermore, conventional thermal printers typically have difficulty accurately reproducing sharp density gradients between adjacent pixels both across the print head and in the direction of printing. For example, if a print head element is to print a black pixel following a white pixel, the ideally sharp edge between the two pixels will typically be blurred when printed. This problem results from the amount of time that is required to raise the temperature of the print head element to print the black pixel after printing the white pixel. More generally, this characteristic of conventional thermal printers results in less than ideal sharpness when printing images having regions of high density gradient.

The above-referenced patent applications disclose a model of a thermal print head that predicts the thermal response of thermal print head elements to the provision of energy to the print head elements over time. The amount of energy to provide to each of the print head elements during a print head cycle in order to produce a spot having the desired density is calculated based on: (1) the desired density to be produced by the print head element during the print head cycle, (2) the predicted temperature of the print head element at the beginning of the print head cycle, (3) the ambient printer temperature at the beginning of the print head cycle, and (4) the ambient relative humidity.

The techniques disclosed therein assume that printing is performed in equal time steps, and therefore calculate the input energy in equal time steps, each corresponding to the time taken to print a single pixel on the thermal medium. In particular, the disclosed techniques implement a thermal model for the thermal print head. The thermal model is composed of multiple layers, each having a different spatial and temporal resolution. The resolutions for the layers are chosen for a combination of accuracy and computational efficiency.

Furthermore, the techniques disclosed in the above-referenced patent applications implement a media model that computes the energy needed to print a desired optical density on the medium, given the current temperature profile of the print element. The media model is expressed in terms of two functions of the desired density, G(d) and S(d). G(d) corresponds to the inverse gamma function at a specified reference temperature, and S(d) is the sensitivity of the inverse gamma function to temperature at a fixed density.

The assumption that all print intervals are of equal duration may not be valid under all circumstances. For example, in the system disclosed in the above-referenced patent application entitled "Thermal Imaging System," the print head is capable of writing two colors in a single pass on a single print medium. Each print line time is divided into two parts. It is possible to write one color in one part of the line time and another color in another part of the line time. The time division between the two colors, however, may not be equal. For example, if printing yellow and magenta, the yellow may be printed during a smaller fraction of the line time interval than magenta. An attempt to apply the thermal history control techniques disclosed above to such a print mechanism may, therefore, produce suboptimal results, because the assumption of equally-sized print intervals would be violated.

What is needed, therefore, are improved techniques for controlling the temperature of print head elements in a thermal printer having unequally-sized print intervals to more accurately render digital images.

SUMMARY

Techniques are disclosed for performing thermal history control in a thermal printer in which a single thermal print head prints sequentially on multiple color-forming layers in a single pass. Each pixel-printing interval may be divided into subintervals, which may be of unequal duration. Each sub-interval may be used to print a different color. The manner in which the input energy to be provided to each print head element is selected may be varied for each of the subintervals. For example, although a single thermal model may be used to predict the temperature of the print head elements in each of the subintervals, different parameters may be used in the different subintervals. Similarly, different energy computation functions may be used to compute the energy to be provided to the print head in each of the subintervals based on the predicted print head element temperature.

For example, in one aspect of the present invention, a method is provided which includes steps of: (A) identifying a density of a pixel in a digital image, the density including: (1) a first color component associated with a first printing subinterval of a printing line time and having a first value, and (2) a second color component associated with a second printing subinterval of the printing line time and having a second value; (B) identifying a first print head element temperature; (C) identifying a first energy computation function associated with the first color component; (D) identifying a first input energy using the first energy computation function based on the first value and the first print head element temperature; (E) identifying a second print head element temperature; (F) identifying a second energy computation function associated with the second color component; and (G) identifying a second input energy using the second energy computation function based on the second value and the second print head element temperature.

In another aspect of the present invention, a method is provided which includes steps of: (A) identifying a density of a pixel in a digital image, the density including a first color component having a first value and a second color component having a second value; (B) predicting a first temperature of a print head element at the beginning of a first subinterval associated with the first color component; and (C) predicting a second temperature of a print head element at the beginning of a second subinterval associated with the second color component; wherein the first subinterval differs in duration from the second subinterval.

Additional aspects and embodiments of the present invention will be described in more detail below.

DETAILED DESCRIPTION

Techniques are disclosed for performing thermal history control in a thermal printer in which a single thermal print head prints sequentially on multiple color-forming layers in a single pass. Each pixel-printing interval may be divided into subintervals, which may be of unequal duration. Each sub-interval may be used to print a different color. The manner in which the input energy to be provided to each print head element is selected may be varied for each of the subintervals. For example, although a single thermal model may be used to predict the temperature of the print head elements in each of the subintervals, different parameters may be used in the different subintervals. Similarly, different energy computation functions may be used to compute the energy to be provided to the print head in each of the subintervals based on the predicted print head element temperature.

For example, in the above-referenced patent applications, techniques are disclosed for performing thermal history control by computing the input energy to provide to a print head element at each of a plurality of successive time steps based on the predicted temperature of the print head element at the beginning of each of the time steps and a plurality of 1-D functions of desired density. All of the time steps are assumed to be of equal duration, and each time step is assumed to be equal in duration to the amount of time required to print a single pixel. For example, referring to FIG. 1A, a diagram is shown illustrating such a pixel printing scheme. The diagram illustrates a plurality of successive time steps 102*a-c* of equal duration. Each of the time steps 102*a-c* corresponds to one of a plurality of pixel-printing times 104*a-c*. In other words, a single pixel is printed during each of the successive time steps 102*a-c*.

A thermal model may be used to predict the temperature of each thermal print head element at the beginning of each of the time steps 102*a-c*. An energy computation function may then be used to compute the input energy to provide to each of the print head elements during each of the time steps 102*a-c*. The computed energies may be provided to the print head elements during each of the corresponding pixel-printing intervals to print pixels of the appropriate densities.

The above-referenced patent application entitled "Thermal Imaging System" describes a thermal printing system in which a single thermal print head prints sequentially on multiple color-forming layers in a single pass. In such a system, each pixel-printing time may be divided into two or more sub-intervals, each corresponding to the time during which printing is accomplished on each of the different color-forming layers. Such subintervals typically are of different durations.

Figure 1A:
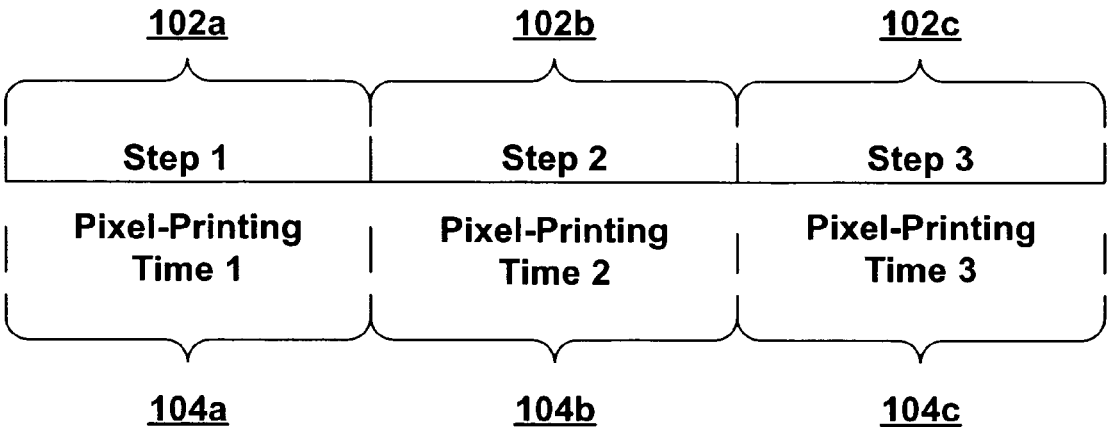
FIG. 1A is a diagram illustrating pixel-printing intervals in a thermal printer in which pixels are printed in successive time steps of equal duration.
Figure 1B:
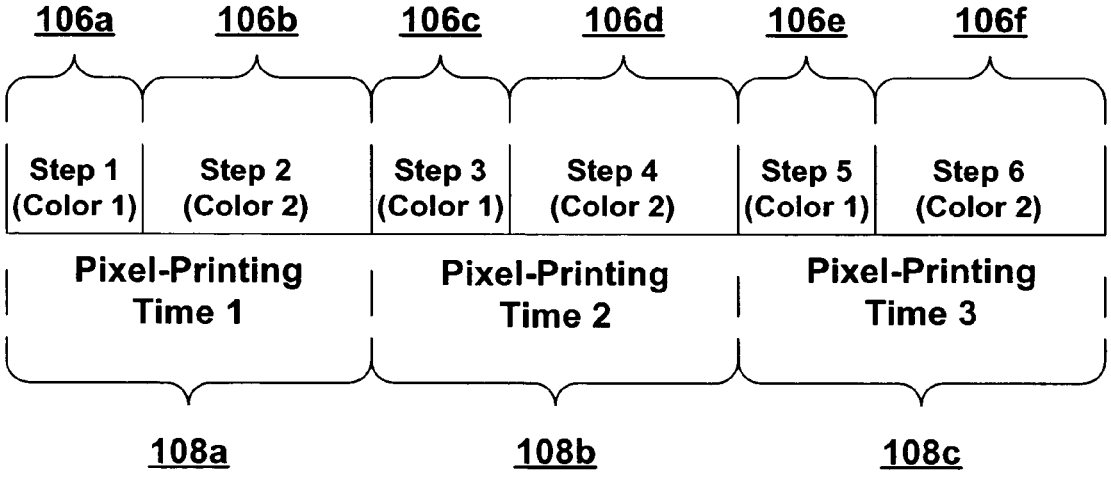
FIG. 1B is a diagram illustrating pixel-printing intervals in a printer in which each pixel is printed using a plurality of time steps of possibly unequal duration.

For example, referring to FIG. 1B, a diagram is shown illustrating such a pixel printing scheme, in which a single print head alternately prints two colors in a single pass. For purposes of example, the diagram illustrates a plurality of successive time steps 106*a-f* of unequal duration. Each successive pair of time steps 106*a-f* corresponds to one of a plurality of pixel-printing times 108*a-c*. In particular, time steps 106*a-b* correspond to pixel-printing time 108*a*, time steps 106*c-d* correspond to pixel-printing time 108*b*, and time steps 106*e-f* correspond to pixel-printing time 108*c*.

In each pair of time steps 106*a-f*, the first step corresponds to a pixel-printing subinterval in which a first color is printed, and the second step corresponds to a pixel-printing subinterval in which a second color is printed. For example, the first color may be printed during subintervals corresponding to time steps 106*a*, 106*c*, and 106*e*, while the second color may be printed during subintervals corresponding to time steps 106*b*, 106*d*, and 106*f*.

Note that the system illustrated in FIG. 1B differs from the system illustrated in FIG. 1A in two ways: (1) the time steps 102*a-c* in FIG. 1A are of equal duration, while the time steps 106*a-f* in FIG. 1B are of unequal duration; and (2) the print head prints a single color in FIG. 1A, while the print head alternately prints two colors on two color-forming layers in FIG. 1B.

The thermal history control techniques disclosed in the above-referenced patent applications may be modified to accommodate the features of the system shown in FIG. 1B. For example, in one embodiment of the present invention, techniques are provided for predicting the temperature of the print head elements at the beginnings of successive time steps of unequal duration. In another embodiment of the present invention, techniques are provided for computing the energies to provide to the print head elements based on properties of the color-forming layer on which the print head elements are printing. Both techniques may be combined with each other, thereby providing the ability to perform thermal history control in a printer which is capable of printing sequentially on multiple color-forming layers using printing subintervals of unequal durations.

Figure 2A:
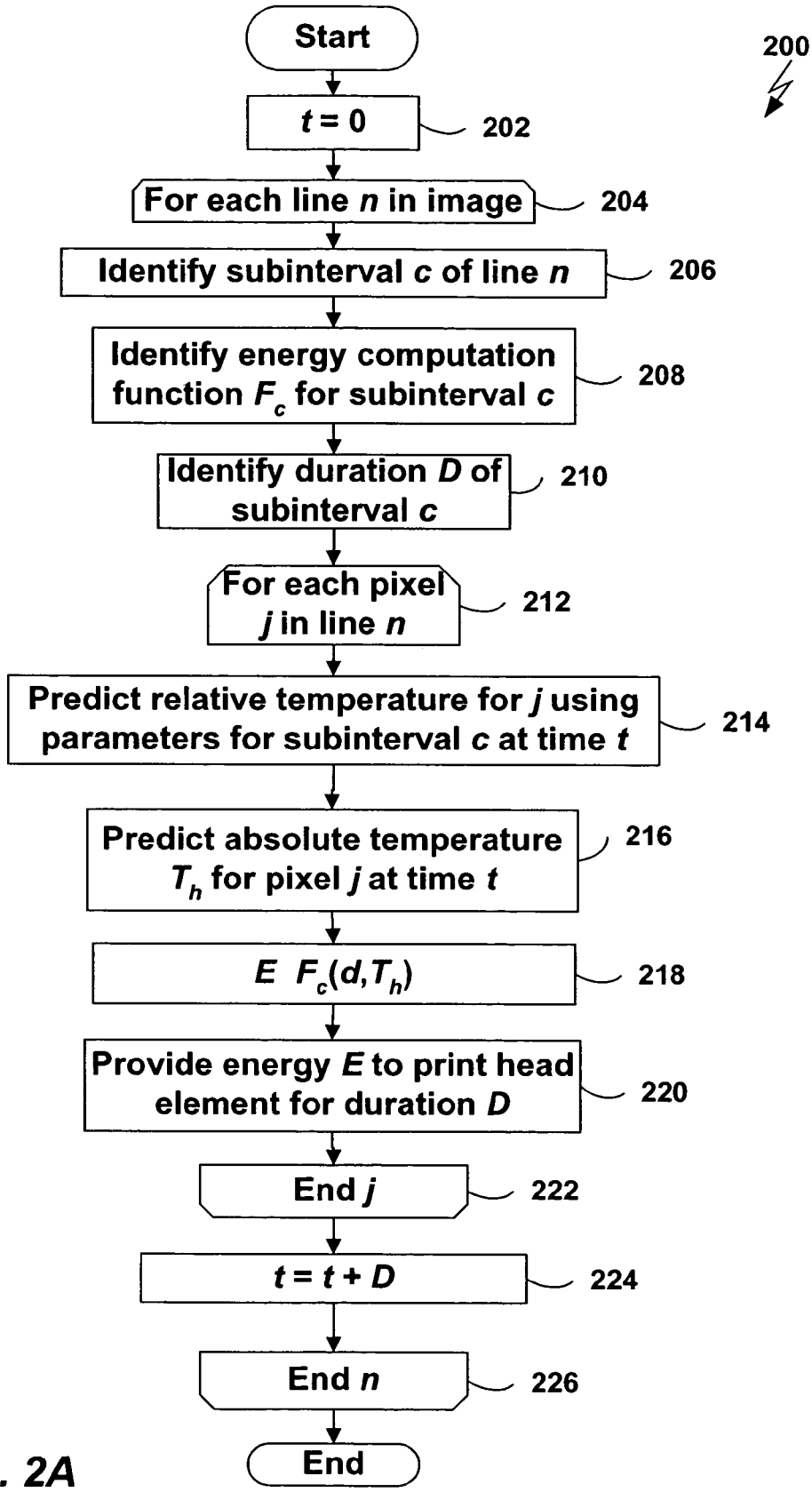
FIG. 2A is a flowchart of a method performed in one embodiment of the present invention to perform thermal history control on a digital image.
Figure 2B:
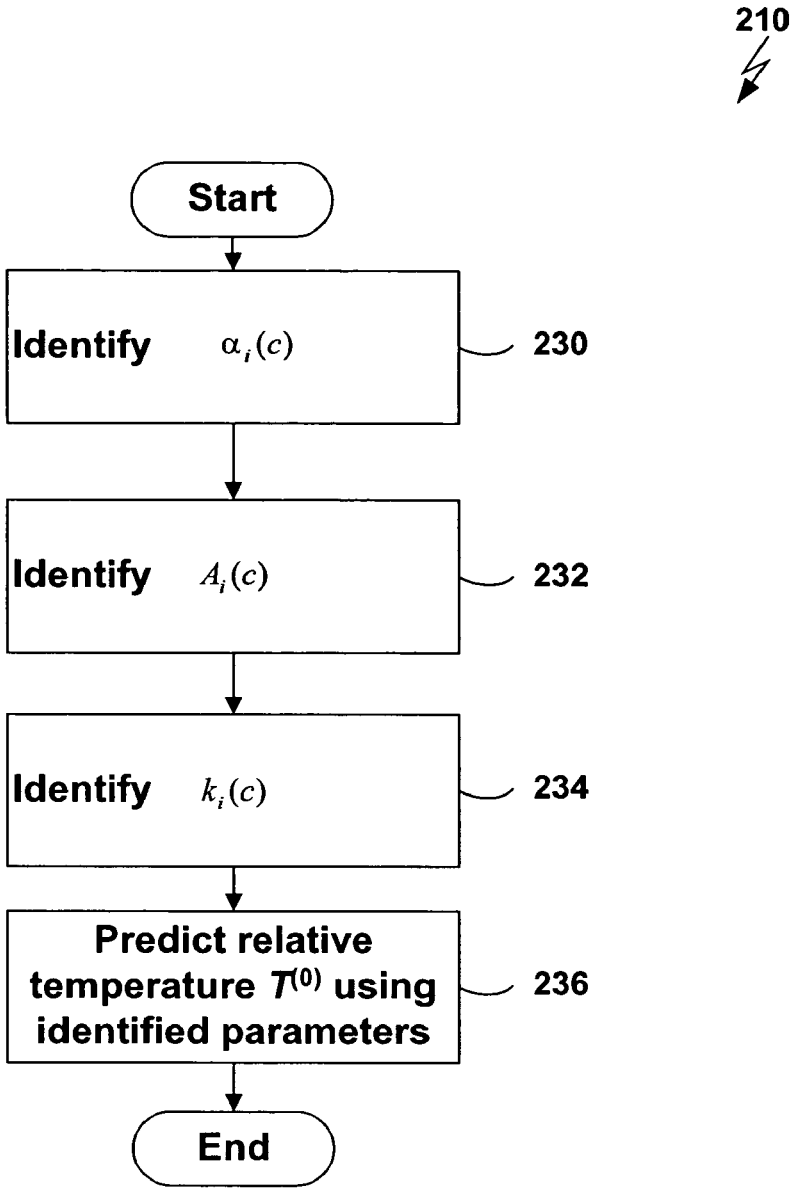
FIG. 2B is a flowchart of a method that is used in one embodiment of the present invention to predict a print head element temperature using parameters associated with one of a plurality of pixel-printing subintervals.
Figure 2C:
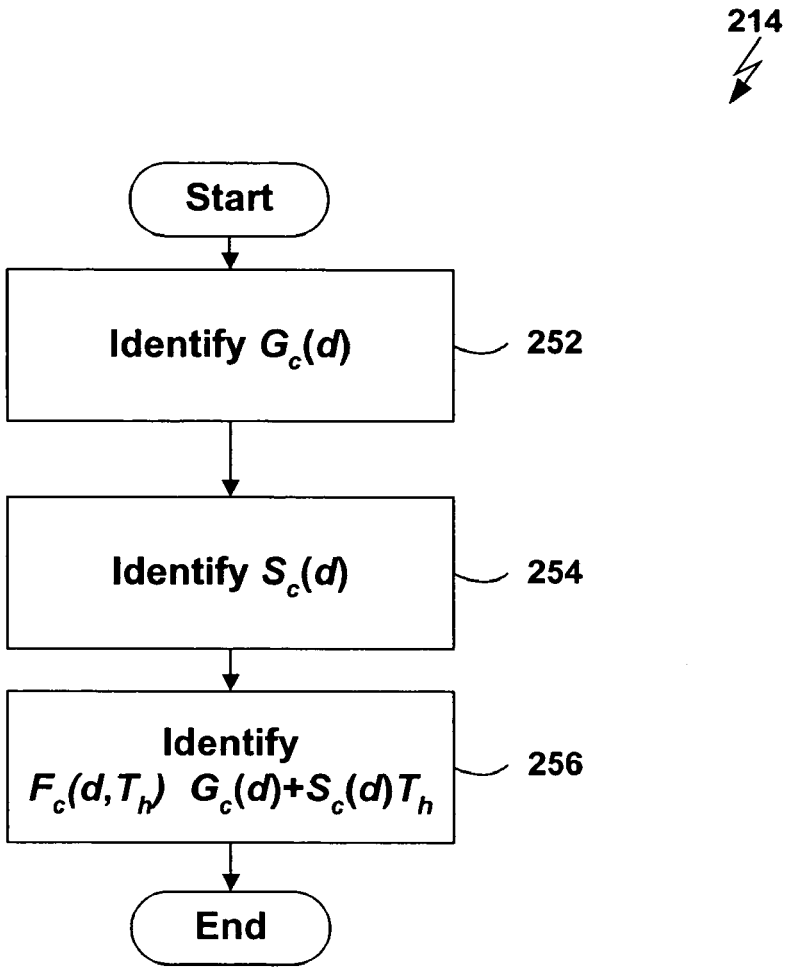
FIG. 2C is a flowchart of a method performed in one embodiment of the present invention to calculate the input energy to provide to a print head element using functions associated with one of a plurality of pixel-printing subintervals.

Referring to FIG. 2A, a flowchart is shown of a method 200 that is performed in one embodiment of the present invention to perform thermal history control on a digital image. As described in more detail below, the method 200 may predict the temperature of each of a plurality of print head elements at the beginning of each of a plurality of pixel-printing time subintervals. The subintervals may, for example, be of unequal duration, as in the case of the subintervals 106*a-f* shown in FIG. 1B. Furthermore, the method 200 may vary the energy computation function that is used to calculate the input energy to provide to the print head elements during the subintervals.

Assume that the method 200 is used to print a multi-color digital image including a plurality of pixels. Assume further that the image is represented in three dimensions: width, length, and color. Such an image may be transformed into an equivalent two-dimensional image with interleaved lines of alternating color, effectively combining the length and the color into a single dimension.

Figure 1C:
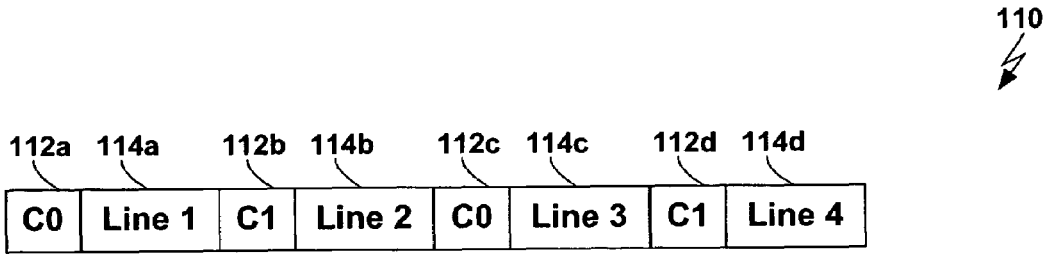
FIG. 1C is a diagram of a multi-color digital image according to one embodiment of the present invention.

For example, referring to FIG. 1C, a diagram is shown illustrating a two-dimensional 2-color digital image 110, which includes alternating lines of pixels with colors 0 and 1. Each line is tagged to indicate its color. For example, image 110 includes a first tag 112*a* specifying color 0, thereby indicating that the subsequent line 114*a* of pixels has color 0. Second tag 112*b* specifies color 1, thereby indicating that the subsequent line 114*b* of pixels has color 1. Third tag 112*c* specifies color 0, thereby indicating that the subsequent line 114*c* of pixels has color 0. Tag 112*d* specifies color 1, thereby indicating that the subsequent line 114*d* of pixels has color 1. It should be appreciated from FIG. 1C that the image 110 may include subsequent lines of similarly-tagged pixels. The digital image 110 may thereby represent a multi-color image using a single linear array of tags and pixel lines. Assume in the following discussion of FIG. 2 that the digital image to be printed is represented in this manner.

Representing the image 110 in the format illustrated in FIG. 1C enables the thermal history control techniques disclosed in the above-referenced patent applications to be applied straightforwardly to the image 110, assuming that the line times are equal for all colors and that the color-forming chemistry is the same for all colors. If, however, either or both of these assumptions are not valid, then the differences in line times and/or color-forming chemistry should be taken into account when performing thermal history control to obtain optimal results. Examples of techniques will now be described for applying the previously-disclosed thermal history control techniques when the line times and/or color forming chemistry differs from color to color. It should be assumed that aspects of the thermal history control algorithm which are not described explicitly herein may be implemented in the manner disclosed in the above-referenced patent applications.

The method 200 initializes a time t to zero (step 202). The time t=0 may, for example, correspond to the beginning of subinterval 106*a* in FIG. 1B. The method 200 enters a loop over each line n in the image to be printed (step 204). The method 200 identifies the subinterval c of the current line n (step 206). The method 200 may, for example, identify the subinterval c using the color tag preceding line n, assuming that there is a one-to-one correspondence between colors and subintervals (FIG. 1C).

In one embodiment of the present invention, each of the subintervals is associated with a possibly distinct energy computation function. The method 200 identifies an energy computation function $F_c$ corresponding to the subinterval c (step 208). Examples of techniques that may be used to identify the energy computation function will be described below with respect to FIG. 2C.

The method 200 identifies the duration D of subinterval c (step 210). As shown in FIG. 1B, the duration of subinterval c may differ from the duration of other subintervals in the same pixel-printing time. For example, subinterval 106*a* is shorter in duration than subinterval 106*b*.

The method 200 enters a loop over each pixel j in line n (step 212). In one embodiment of the present invention, a thermal model is provided for predicting the temperature of print head elements at the beginning of pixel-printing subintervals. Such a thermal model may, for example, be implemented in the manner described in the above-referenced patent applications. In one embodiment of the present invention, each pixel-printing subinterval is associated with a possibly distinct set of thermal model parameters. Returning to FIG. 2A, the method 200 uses the thermal model parameters associated with subinterval c to predict the relative temperature T of the print head element that is to print pixel j at time t (step 214). Examples of techniques that may be used to perform step 214 are described below with respect to FIG. 2B.

The thermal model described in the above-referenced patent application includes a plurality of layers, each of which may be associated with one or more relative temperatures. Although step 214 only refers to the finest-resolution layer in the thermal model, those having ordinary skill in the art will appreciate that generating the relative temperature predictions in step 214 will involve updating relative temperature predictions in other layers of the model.

The method 200 predicts the absolute temperature $T_h$ of the print head element that is to print pixel j at time t using the relative temperature T of the print head element (step 216). (Note that the variable $T_a$ represented the absolute temperature in patent application Ser. No. 09/934,703, while the variable $T_h$ represented the absolute temperature in patent application Ser. No. 10/831,925.) As will be described in more detail below, the print head element temperature prediction techniques disclosed in the above-referenced patent applications may be modified to implement step 216.

The method 200 computes the input energy E based on the print density d and the absolute print head element temperature $T_h$ (step 218). The method 200 provides the computed energy E to the appropriate print head element for the duration of the subinterval c (step 220).

The method 200 repeats steps 214-220 for the remaining pixels in the current line n (step 222). The method 200 advances time t to the beginning of the next subinterval by adding D to t (step 224). For example, if the current value of t points to the beginning of subinterval 106*a*, , then adding the duration of subinterval 106*a* to t would cause t to point to the beginning of the next subinterval 106*b*.

The method 200 repeats steps 206-224 for the remaining lines in the image to be printed (step 226). The method 200 thereby performs thermal history control on the digital image. As illustrated by the preceding description, the method 200 may take into account the unequal durations of the time steps 106*a-f* when predicting the relative and absolute temperatures of print head elements. Additionally or alternatively, the method 200 may take into account the different thermal characteristics of the different color-forming layers of the print medium when selecting either or both of: (1) the thermal model parameters, and (2) the energy computation function.

In the above-referenced U.S. patent application. Ser. No. 09/934,703, entitled "Thermal Response Correction System," the following equations were used to update relative temperature predictions:

$$T^{(i)}(n,j)=T^{(i)}(n-1,j)\alpha_i+A_iE^{(i)}(n-1,j) \quad \text{Equation 1}$$

$$T^{(i)}(n,j)=(1-2k_i)T^{(i)}(n,j)+k_i(T^{(i)}(n,j-1)+T^{(i)}(n,j+1)) \quad \text{Equation 2}$$

As described in more detail in that patent application, absolute temperatures $T_h$ of the print head elements may be predicted based on the relative temperatures T. Recall that the thermal model includes a plurality of layers. The notation $T^{(i)}(n,j)$ refers to the relative temperature at layer i and index j at the beginning of print head cycle n. $T^{(0)}(n,j)$ refers to the relative temperature of layer 0, which has a one-to-one correspondence with the print head elements.

Equation 1 depends on two parameters, $\alpha_i$ and $A_i$, whose values depend on the size of the time step. Therefore, to apply Equation 1 to time steps of unequal duration, the values of these two parameters may be alternated from one time-step to the next, in sequence with the change of the step size. Likewise, Equation 2 depends on a parameter $k_i$, that is also changed in sequence with the step size.

For example, let C be the number of color-forming layers (and therefore also the number of subintervals). Distinct values of $\alpha_i(c)$, $A_i(c)$, and $k_i(c)$ may be selected for $0 \leqq c < C$. Then, the relative print head element temperature $T^{(0)}(n,j)$ may be identified for each subinterval using the method shown in FIG. 2B, thereby implementing step 214 of method 200 (FIG. 2A). For subinterval c, values of $\alpha_i(c)$ (step 230), $A_i(c)$ (step 232), and $k_i(c)$ (step 234) are identified. The relative head element temperature $T^{(0)}$ at the beginning of subinterval c may then be predicted using the parameter values identified in steps 230-234 (step 236). In particular, Equation 1 and Equation 2 may be modified as follows for use in step 226:

$$T^{(i)}(n,j)=T^{(i)}(n-1,j)\alpha_i(c)+A_i(c)E^{(i)}(n-1,j) \quad \text{Equation 3}$$

$$T^{(i)}(n,j)=(1-2k_i(c))T^{(i)}(n,j)+k_i(c)(T^{(i)}(n,j-1)+T^{(i)}(n,j+1)) \quad \text{Equation 4}$$

In one embodiment of the present invention, thermal model parameters are only varied from color to color at the finest-resolution layer (i=0) of the thermal model. One way to accomplish this result is to use the same parameter values for each subinterval in all layers of the thermal model other than layer 0.

As described above, the above-referenced patent application entitled "Thermal Imaging System" describes a thermal printing system in which a single thermal print head prints sequentially on multiple color-forming layers in a single pass. Each of the color-forming layers typically has different thermal characteristics. Therefore, in one embodiment of the present invention, the input energy to provide to the print head is computed using a different energy computation function for each color-forming layer (i.e., for each color). The energy computation function may compute the input energy based on a predicted head element temperature. The head element temperature may be computed using a head element temperature model that differs for each color-forming layer (i.e., for each color). For example, one or more parameters of the head temperature model may be modified for each of the color-forming layers.

As described in the above-referenced U.S. patent application Ser. No. 10/831,925, entitled "Thermal Response Correction System," the energy computation function may be expressed as shown in Equation 5:

$$E=F(d,T_h) \quad \text{Equation 5}$$

In Equation 5, E is the input energy, d is the desired density of the pixel to be printed, and $T_h$ is the (predicted or measured) absolute print head element temperature at the beginning of a subinterval. As further described in the above-referenced patent application, additional parameters may be added to the energy computation function, such as the ambient printer temperature $T_r$ and the relative humidity RH to take such quantities into account when computing the input energy E. For purposes of simplicity, the following discussion will refer to the two-parameter Equation 5, although those having ordinary skill in the art will understand how to apply the description below to energy computation functions which further incorporate the ambient printer temperature $T_r$ and the relative humidity RH.

The energy computation function shown in Equation 5 may be approximated by the function shown in Equation 6:

$$E=G(d)+S(d)T_h \quad \text{Equation 6}$$

In Equation 6, G(d) corresponds to the inverse gamma function at a specified reference temperature of zero, and S(d) is the sensitivity of the inverse gamma function to temperature variations away from the reference temperature at a fixed density. In one embodiment of the present invention, different G(d) and S(d) functions are used to compute the input energy to be provided for each of the color-forming layers. For example, in a system which uses a print medium having three color-forming layers, three distinct G(d) and S(d) functions may be used.

Such multiple functions may, for example, be represented by functions $G_c(d)$ and $S_c(d)$, for $0 \leqq c < C$. Then, the energy computation function $F_c$ may be identified using the method shown in FIG. 2C, thereby implementing step 208 of method 200 (FIG. 2A). For subinterval c, functions $G_c(d)$ (step 252) and $S_c(d)$ (step 254) are identified. The energy computation function $F_c$ may then be identified as the function $F_c(d, T_h)=G_c(d)+S_c(d)T_h$ (step 256).

With the modifications described above, the thermal history control algorithm maintains a running estimate of the temperature profile of the thermal print head and applies the appropriate thermal corrections to the energies applied to the heaters while writing on each of the color-forming layers. As is apparent from the description herein, the method may be used in conjunction with any number of color-forming layers, in which case there is a longer sequence of unequal time steps, with corresponding parameters $\alpha_i$, $A_i$, and $k_i$, for each size of time step, and functions G(d) and S(d) for each associated color-forming layer.

The above-referenced patent application Ser. No. 10/831,925 discloses techniques for taking changes in ambient printer temperature into account when performing thermal history control. Examples of techniques will now be described for taking changes in ambient printer temperature into account when performing thermal history control in a thermal printer in which a single thermal print head prints sequentially on multiple color-forming layers in a single pass.

As described in more detail in the above-referenced patent application Ser. No. 10/831,925, the input energy may be computed based on the media temperature $T_m$ rather than the print head element temperature $T_h$, using Equation 7:

$$E=G'(d)+S'(d)T_m \quad \text{Equation 7}$$

In Equation 7, G'(d) and S'(d) are related to the functions G(d) and S(d). For short printer line times, the media temperature $T_m$ may be approximated by Equation 8:

$$T_m=T_r+A_m(T_h-T_r) \quad \text{Equation 8}$$

$T_r$ represents the ambient temperature of the printer. $A_m$ is a constant derived from the printer line time and thermal characteristics of the media. As noted above, the thermal characteristics of the media and the subinterval duration may vary from subinterval to subinterval. Therefore, in one embodiment of the present invention, a different value of $A_m$ is used in each of the subintervals. $A_m(c)$ refers herein to the value of $A_m$ for subinterval c.

Figure 2D:
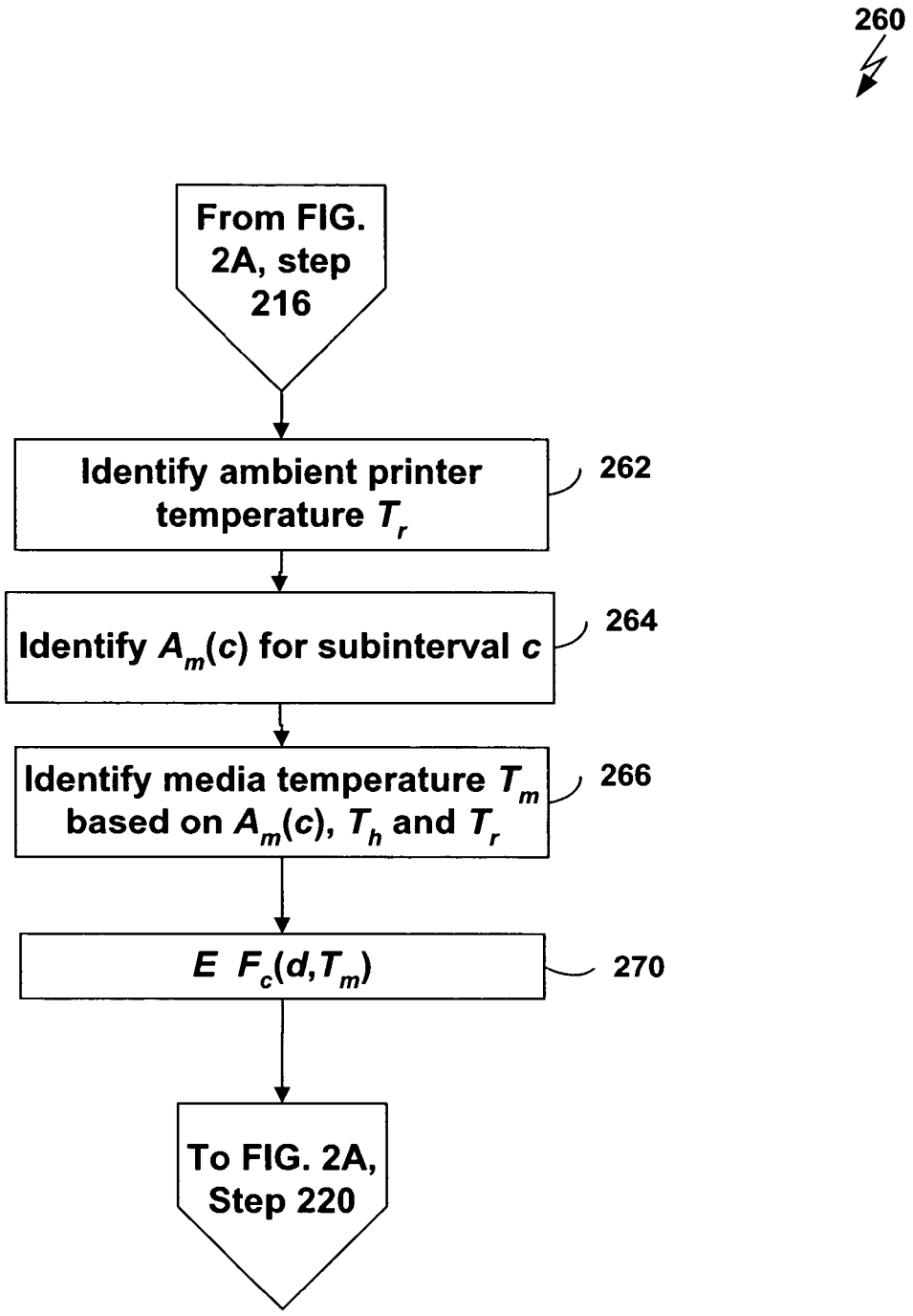
FIG. 2D is a flowchart of a method that is used in one embodiment of the present invention to compute the input energy to provide to a thermal printer based on the current media temperature.

For example, referring to FIG. 2D, a flowchart is shown of a method 260 that is used in one embodiment of the present invention to compute the input energy E based on the current media temperature $T_m$. In the embodiment illustrated in FIG. 2D, the media temperature $T_m$ is computed for each pixel.

The method 260 begins after step 216 of the method 200 shown in FIG. 2A. The method 260 identifies the ambient printer temperature $T_r$, as described in the above-referenced patent applications (step 262). The method 260 identifies the value of $A_m(c)$ that corresponds to subinterval c (step 264). The method 260 identifies the media temperature $T_m$ based on the values of $A_m(c)$, $T_h$, and $T_r$, such as by using Equation 8 (step 266).

Recall that the energy computation function $F_c$ for subinterval c was previously identified in step 208. In the case of the method 260 shown in FIG. 2D, the energy computation function $F_c$ may be a function of density d and media temperature $T_m$, rather than a function of density d and print head temperature $T_h$ as described above with respect to FIG. 2A. Such an energy computation function may, for example, have the form shown in Equation 7, in which case there may be distinct functions $G'_c(d)$ and $S'_c(d)$ for each subinterval c. The method 260 computes the input energy E based on the density d and the media temperature $T_m$ using the identified energy computation function (step 270). The method 260 then proceeds to step 220 of the method 200 shown in FIG. 2A.

Figure 2E:
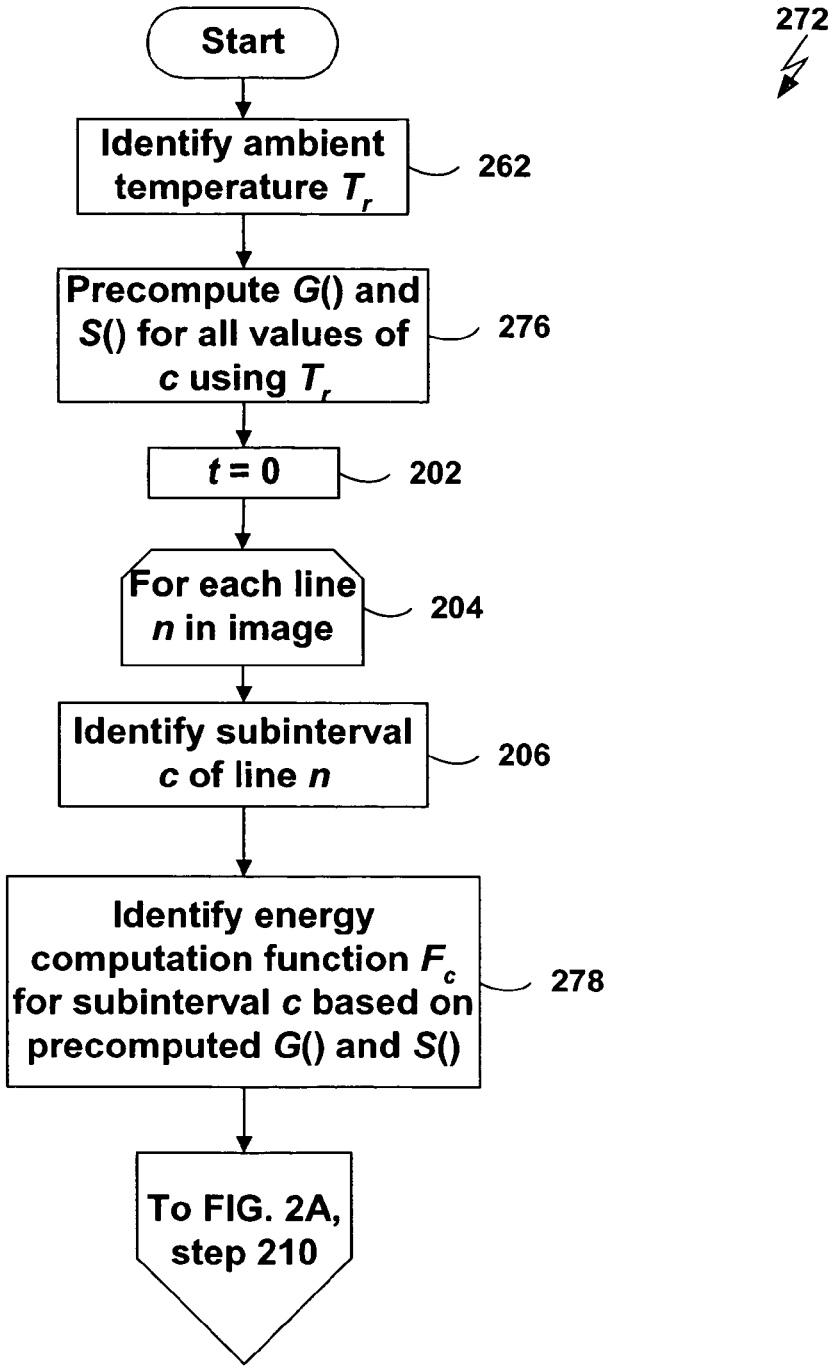
FIG. 2E is a flowchart of a method performed in one embodiment of the present invention to precompute functions used in the method of FIG. 2A and thereby to obtain an increase in computational efficiency.
Figure 2F:
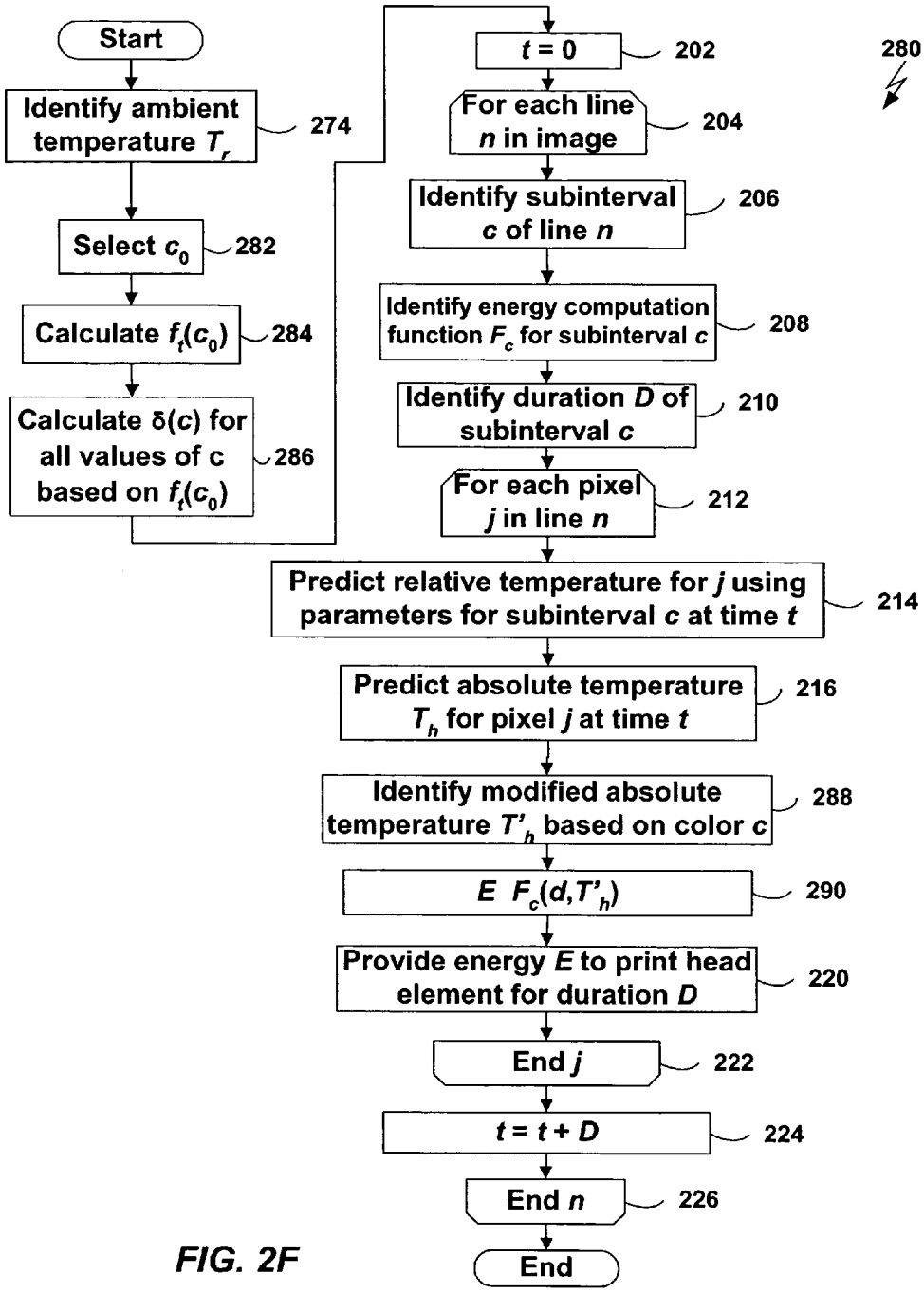
FIG. 2F is a flowchart of a method performed in one embodiment of the present invention to modify the method of FIG. 2A to take into account changes in ambient printer temperature over time.

As described in the above-referenced patent application Ser. No. 10/831,925, the ambient printer temperature $T_r$ will typically have a long time constant and therefore may not be expected to change significantly during a single print job. Referring to FIG. 2E, a flowchart is shown of a method 272 for applying the precomputation techniques disclosed in the above-referenced patent application to the method 200 shown in FIG. 2A. The method 272 identifies the ambient temperature $T_r$ (step 262), as described above with respect to FIG. 2D. The method 272 precomputes the functions G(·) and S(·) for all values of c using the identified value of $T_r$ (step 276). Step 276 may, for example, be implemented using Equation 9 and Equation 10:

$$G(d,T_r)=G'(d)+S'(d)(1-A_m(c))T_r \quad \text{Equation 9}$$

$$S(d)=S'(d)A_m(c) \quad \text{Equation 10}$$

The method 272 then performs steps 202, 204, and 206, as described above with respect to the method 200 of FIG. 2A. The method 272 then identifies the energy computation function $F_c$ for subinterval c based on the precomputed functions G(·) and S(·) (step 278). Having identified these functions, the method 272 performs steps 210-226 (from method 200 of FIG. 2A) using the identified function $F_c$.

In another embodiment described in the above-referenced patent application Ser. No. 10/831,925, a correction term is added to a thermistor temperature $T_s$ to take into account changes in ambient printer temperature over time, using Equation 11:

$$T'_s=T_s+f_t\Delta T_r \quad \text{Equation 11}$$

The adjusted thermistor temperature $T'_s$ is then used to perform thermal history control. In Equation 11, $\Delta T_r=T_r-T_{rc}$ (the difference between the current ambient printer temperature and the ambient printer temperature at which the thermal history control algorithm was calibrated). The correction factor $f_t$, is given by Equation 12:

$$f_t = \frac{(1-A_m)}{A_m} \quad \text{Equation 12}$$

The correction factor $f_t$ shown in Equation 11 and Equation 12, however, is valid only for a particular color (i.e., for a particular value of c) corresponding to the value of $A_m$. Attempts to apply such a correction factor to other colors will produce suboptimal results. In one embodiment of the present invention, the use of the correction factor $f_t$ is modified to apply to a printer that prints sequentially on multiple color-forming layers in a single pass. For example, $f_t$ may be made an express function of c, by using the subinterval-dependent values of $A_m(c)$, as shown in Equation 13:

$$f_t(c) = \frac{(1-A_m(c))}{A_m(c)} \quad \text{Equation 13}$$

A distinct correction factor $f_t(c)$ may thereby be obtained for each value of c. If we select the value of $f_t$ in Equation 11 based on the thermal characteristics of a single one of the color-forming layers, for example $c=c_0$, then the corrected thermistor temperature is given by Equation 14:

$$T'_s=T_s+f_t(c_0)\Delta T_r \quad \text{Equation 14}$$

Any value may be selected for $c_0$. Since the corrected thermistor temperature propagates down to the absolute temperature of all the sub-intervals as described in the above referenced U.S. patent application Ser. No. 09/934,703, the correction is inaccurate for all color forming layers other than $c=c_0$.

In one embodiment of the present invention, additional corrections $\delta(c)$ are then selected for each of the color-forming layers (i.e., for $0 \leqq c < C$), as shown in Equation 15:

$$\delta(c)=(f_t(c)-f_t(c_0))\Delta T_r \quad \text{Equation 15}$$

The net correction may then be added to the absolute temperatures of each of the color-forming layers as in Equation 16.

$$T'_h=T_h+\delta(c) \quad \text{Equation 16}$$

The appropriate value of $\delta(c)$ may then be selected and used in Equation 16 for each subinterval when performing thermal history control. For example, referring to FIG. 2F, a flowchart is shown of a method 280 for modifying the method 200 of FIG. 2A in the manner just described. The method 280 identifies the ambient temperature $T_r$ (step 262) in the manner described above with respect to FIG. 2D. The method 280 selects a value for $c_0$ (step 282) and calculates $f_t(c)$ using Equation 13 with $c=c_0$ (step 284). The method 280 calculates $\delta(c)$ for all values of c using Equation 15 (step 286).

The method 280 performs steps 202-216 as described above with respect to FIG. 2A. After predicting the absolute temperature $T_h$ (step 216), the method 280 identifies the modified absolute temperature $T'_h$ using Equation 16 (step 288). The method 280 computes the input energy E based on the print density d and the modified print head element temperature $T'_h$ (step 290). The method 280 performs steps 220-226 as described above with respect to FIG. 2A.

Note that for $c=c_0$, $\delta(c)=0$. Therefore, as may be seen from Equation 16, no correction to $T_h$ is needed for the color-forming layer for which $c=c_0$, thereby obtaining some savings in computation in steps 288-290. The techniques disclosed herein may be combined with the techniques disclosed in the above-referenced patent application to take the relative humidity into account when performing thermal history control.

The techniques disclosed herein have a variety of advantages. For example, the techniques disclosed herein may be applied to perform thermal history control in a thermal printer in which a single thermal print head prints sequentially on multiple color-forming layers in a single pass. By applying different energy computation functions to different color-forming layers, the techniques disclosed herein enable the thermal history control to be optimized for each of the color-forming layers, thereby improving the quality of printed output. By applying different thermal model parameters to different color-forming layers, the techniques disclosed herein may be used to model the thermal response of the output medium during printing subintervals of unequal duration. As a result, the thermal history control algorithm may be used in conjunction with printers having such unequal subintervals, thereby improving the quality of printed output. Such use of varying energy computation functions and thermal model parameters may be used in combination, thereby optimizing the thermal history control algorithm for use with thermal printers in which a single thermal print head prints sequentially on multiple color-forming layers in a single pass using pixel-printing subintervals of unequal duration.

Furthermore, the techniques disclosed herein have the advantages disclosed in the above-referenced patent applications. For example, the techniques disclosed herein reduce or eliminate the problem of "density drift" by taking the current ambient temperature of the print head and the thermal and energy histories of the print head into account when computing the energy to be provided to the print head elements, thereby raising the temperatures of the print head elements only to the temperatures necessary to produce the desired densities. A further advantage of various embodiments of the present invention is that they may either increase or decrease the input energy provided to the print head elements, as may be necessary or desirable to produce the desired densities.

In general, the techniques described above may be implemented, for example, in hardware, software, firmware, or any combination thereof. The techniques described above may be implemented in one or more computer programs executing on a programmable computer and/or printer including a processor, a storage medium readable by the processor (including, for example, volatile and non-volatile memory and/or storage elements), at least one input device, and at least one output device. Program code may be applied to data entered using the input device to perform the functions described herein and to generate output information. The output information may be applied to one or more output devices.

Printers suitable for use with various embodiments of the present invention typically include a print engine and a printer controller. The printer controller may, for example, receive print data from a host computer and generates page information to be printed based on the print data. The printer controller transmits the page information to the print engine to be printed. The print engine performs the physical printing of the image specified by the page information on the output medium.

Elements and components described herein may be further divided into additional components or joined together to form fewer components for performing the same functions.

Each computer program within the scope of the claims below may be implemented in any programming language, such as assembly language, machine language, a high-level procedural programming language, or an object-oriented programming language. The programming language may be a compiled or interpreted programming language.

Each computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output.

It is to be understood that although the invention has been described above in terms of particular embodiments, the foregoing embodiments are provided as illustrative only, and do not limit or define the scope of the invention. Other embodiments are also within the scope of the present invention, which is defined by the scope of the claims below. Other embodiments that fall within the scope of the following claims includes include, but are not limited to, the following.

What is claimed is:

1. A method comprising steps of:

(A) identifying a density of a pixel in a digital image, the density including: (1) a first color component associated with a first printing subinterval of a printing line time and having a first value, and (2) a second color component associated with a second printing subinterval of the printing line time and having a second value, said first color being different than said second color;

(B) identifying a first print head element temperature;

(C) identifying a first energy computation function associated with the first color component;

(D) identifying a first input energy using the first energy computation function based on the first value and the first print head element temperature;

(E) identifying a second print head element temperature;

(F) identifying a second energy computation function associated with the second color component; and (G) identifying a second input energy using the second energy computation function based on the second value and the second print head element temperature.

2. The method of claim 1, wherein the pixel comprises one of a plurality of pixels in the digital image, and wherein the method further comprises a step of performing steps (A)-(G) for each of the plurality of pixels.

3. The method of claim 1, further comprising steps of:

(H) providing the first input energy to a print head element; and (I) providing the second input energy to the print head element.

4. The method of claim 1, wherein the step (B) comprises a step of predicting the first print head element temperature; and wherein the step (E) comprises a step of predicting the second print head element temperature.

5. The method of claim 4, wherein the step (B) comprises a step of predicting the print head element temperature based on a temperature of a print head of which the print head element is a component.

6. The method of claim 4, wherein the step (B) comprises a step of:

(B)(1) predicting the first print head element temperature based on the first printing subinterval; and wherein the step (E) comprises a step of:

(E)(1) predicting the second print head element temperature based on the second printing subinterval;

wherein the step (D) comprises a step of identifying the first input energy using the first energy computation function based on the first value and the first print head element temperature; and wherein the step (G) comprises a step of identifying the second input energy using the second energy computation function based on the second value and the second print head element temperature.

7. The method of claim 1, wherein the first printing subinterval and the second printing subinterval differ in duration.

8. The method of claim 1, wherein the first energy computation function comprises a first plurality of one-dimensional functions of desired output density.

9. The method of claim 8, wherein the second energy computation function comprises a second plurality of one dimensional functions of desired output density, the second plurality of one dimensional functions being different than the first plurality of one-dimensional functions.

10. The method of claim 1, further comprising a step of:

(H) identifying at least one property selected from the group consisting of an ambient printer temperature and a current humidity; and wherein the step (D) comprises a step of identifying the first input energy using the first energy computation function based on the first value, the print head element temperature, and the at least one identified property.

11. A device comprising:

first identification means for identifying a density of a pixel in a digital image, the density including: (1) a first color component associated with a first printing subinterval of a printing line time and having a first value, and (2) a second color component associated with a second printing subinterval of the printing line time and having a second value, said first color being different than said second color;

second identification means for identifying a first print head element temperature;

third identification means for identifying a first energy computation function associated with the first color component;

fourth identification means for identifying a first input energy using the first energy computation function based on the first value and the first print head element temperature;

fifth identification means for identifying a second print head element temperature;

sixth identification means for identifying a second energy computation function associated with the second color component; and seventh identification means for identifying a second input energy using the second energy computation function based on the second value and the second print head element temperature.

12. The device of claim 11, further comprising:

means for providing the first input energy to a print head element; and means for providing the second input energy to the print head element.

13. The device of claim 11, wherein the second identification means comprises means for predicting the first print head element temperature; and wherein the fifth identification means comprises means for predicting the second print head element temperature.

14. The device of claim 13, wherein the second identification means comprises means for predicting the print head element temperature based on a temperature of a print head of which the print head element is a component.

15. The device of claim 13, wherein the second identification means comprises:

means for predicting the first print head element temperature based on the first printing subinterval; and wherein the fifth identification means comprises:

means for predicting the second print head element temperature based on the second printing subinterval;

wherein the fourth identification means comprises means for identifying the first input energy using the first energy computation function based on the first value and the first print head element temperature; and wherein the seventh identification means comprises means for identifying the second input energy using the second energy computation function based on the second value and the second print head element temperature.

16. The device of claim 11, wherein the first printing subinterval and the second printing subinterval differ in duration.

17. The device of claim 11, further comprising:

eighth identification means for identifying at least one property selected from the group consisting of an ambient printer temperature and a current humidity; and wherein the fourth identification means comprises means for identifying the first input energy using the first energy computation function based on the first value, the print head element temperature, and the at least one identified property.

18. A method comprising steps of:

(A) identifying a density of a pixel in a digital image, the density including a first color component having a first value and a second color component having a second value, said first color being different than said second color);

(B) predicting a first temperature of a print head element at the beginning of a first subinterval associated with the first color component; and (C) predicting a second temperature of a print head element at the beginning of a second subinterval associated with the second color component;

wherein the first subinterval differs in duration from the second subinterval.

19. The method of claim 18, further comprising steps of:

(D) identifying a first energy based on the first temperature and the first value;

(E) providing the first energy to the print head element during the first subinterval;

(F) identifying a second energy based on the second temperature and the second value; and (G) providing the second energy to the print head element during the second subinterval.

20. The method, of claim 18, wherein the pixel comprises one of a plurality of pixels in a digital image, and wherein the method further comprises a step of performing steps (A)-(C) for each of the plurality of pixels.

21. The method of claim 18, wherein the step (B) comprises a step of predicting the first temperature based on the first value and a temperature of a print head of which the print head element is a component.

22. The method of claim 21, wherein the step (B) comprises a step of predicting the first temperature based on the first value, the temperature of the print head, and at least one property selected from the group consisting of an ambient printer temperature and a current humidity.

23. The method of claim 18, wherein the step (B) comprises a step of predicting the first temperature using a temperature model with a first set of parameters associated with the first color component, and wherein the step (C) comprises a step of predicting the second temperature using the temperature model with a second set of parameters associated with the second color component, the first set differing from the second set.

24. A device comprising:

first identification means for identifying a density of a pixel in a digital image, the density including a first color component having a first value and a second color component having a second value, said first color being different than said second color;

first prediction means for predicting a first temperature of a print head element at the beginning of a first subinterval associated with the first color component; and second prediction means for predicting a second temperature of a print head element at the beginning of a second subinterval associated with the second color component;

wherein the first subinterval differs in duration from the second subinterval.

25. The device of claim 24, further comprising:

second identification means for identifying a first energy based on the first temperature and the first value; first energy provision means for providing the first energy to the print head element during the first subinterval;

third identification means for identifying a second energy based on the second temperature and the second value; and second energy provision means for providing the second energy to the print head element during the second subinterval.

26. The device of claim 24, wherein the first prediction means comprises means for predicting the first temperature based on the first value and a temperature of a print head of which the print head element is a component.

27. The device of claim 26, wherein the first prediction means comprises means for predicting the first temperature based on the first value, the temperature of the print head, and at least one Property selected from the group consisting of an ambient printer temperature and a current humidity.

28. The device of claim 24, wherein the first prediction means comprises means for predicting the first temperature using a temperature model with a first set of parameters associated with the first color component, and wherein the second prediction means comprises means for predicting the second temperature using the temperature model with a second set of parameters associated with the second color component, the first set differing from the second set.

* * * * *